United States Patent [19]

Minton

[11] 3,942,216

[45] Mar. 9, 1976

[54] NOZZLE WITH EDGE CLEANING

[75] Inventor: Keith G. Minton, North Canton, Ohio

[73] Assignee: The Hoover Company, North Canton, Ohio

[22] Filed: Mar. 4, 1974

[21] Appl. No.: 447,646

[52] U.S. Cl. ..... 15/331; 15/416; 15/419

[51] Int. Cl.[2] ..... A47L 9/02

[58] Field of Search ..... 15/331, 404, 416, 419

[56] References Cited

UNITED STATES PATENTS

| | | | |
|---|---|---|---|
| 1,782,882 | 11/1930 | Rippey | 15/416 X |
| 2,257,574 | 9/1941 | Ray | 15/404 |
| 2,321,648 | 6/1943 | Brunner, Jr. | 15/404 |
| 2,864,119 | 12/1958 | Crise | 15/404 |
| 3,205,528 | 9/1965 | Fromknecht et al. | 15/416 |

*Primary Examiner*—Billy J. Wilhite
*Assistant Examiner*—C. K. Moore

[57] ABSTRACT

A wheeled suction nozzle is provided having, generally, a simplified three-piece construction including an upper shell, an intermediate plate and a bottom pan, with the intermediate plate sandwiched between the other two members so that its top surface and the bottom surface of the upper shell form the suction passageways for the nozzle.

A rotary valve is included to activate edge or normal suction, with this valve rotating on a vertical axis and snapfit into position and thus not requiring any sort of connecting means which would positively maintain the rotary valve attached to the nozzle.

4 Claims, 7 Drawing Figures

NOZZLE WITH EDGE CLEANING

BACKGROUND OF THE INVENTION

1. Field of the Invention

This invention relates to vacuum cleaners and, more specifically, to a floor nozzle usable with such a cleaner.

2. Description of the Prior Art

It is old and well known in the cleaner art to provide floor-engaging nozzles for general cleaning utility of floors, rugs and the like. It is also old in the cleaner art to include an edge cleaning feature in such a floor-engaging nozzle but heretofore nozzles of this type have been required to be of relatively complicated structure so as to effectively form both edge and front cleaning passageways and, at the same time, make provision for operator selection of whichever of these two cleaning features is desired to be used at a particular time.

Accordingly, it would be advantageous to provide a simplified cleaning nozzle structure by encapsulating the air passageways within the nozzle between two easily molded members such as the bottom of an upper shell member and the adjacent top of a member disposed therebelow.

It would be further advantageous to then utilize the conventional, requisite wear member, bottom plate, to maintain the assemblage of the other two members so that, in effect, the lower member forming a part of the air passageways was sandwiched between the outer shell member and the bottom plate.

It would be still further advantageous to include as a part of the floor nozzle structure a rotary valve for initiation of edge or front cleaning and to mount this valve to form a vertically disposed axis for it for easy operator accessability and minimum requisite connective mounting structure.

Further and additional advantages offered by the structure disclosed will become apparent as the description proceeds.

SUMMARY OF THE INVENTION

The invention is provided in a wheeled rug and floor nozzle that is normally to be used as an auxiliary cleaning tool attached to a suction hose of a canister cleaner or the like. Such a nozzle, then, can be advantageously utilized for the cleaning of carpeting in a manner similar to that employed with an upright cleaner by rolling the nozzle backwardly and forwardly over the dirty carpet so that suction provided at a nozzle face will pick up dirt and litter contained on and in the carpet's surface.

The nozzle includes, at the hose end, a tubular conduit section for easy connection to the cleaner suction hose. This tubular conduit section integrally merges into a boss portion that is pivotally attached to the floor-engaging nozzle section, proper, to permit pivoting of the suction hose relative to the floor-engaging nozzle section of the nozzle. A horizontally extending slot in the boss portion provides suction communication between it and the floor-engaging nozzle section.

At a rearward portion of the floor-engaging nozzle section a closed yoke configuration is included which pivotally receives the boss portion and provides support for a pair of wheels that rollably support the nozzle. Forwardly of the yoke configuration and integrally attached to it is an upper shell portion of the floor-engaging section that forms the top and downwardly engaging edges of it. Received within this upper shell is an intermediate plate member that is spaced from the bottom of the upper shell by pendant, integral walls of it to thereby form the requisite suction passageways that open downwardly through the intermediate plate at its front and side edges. The nozzle is, thus, imbued with both normal and edge cleaning functions.

Disposed below the intermediate plate and acting as one half of a sandwich arrangement for it is a conventional bottom wear piece, also having openings for edge and conventional front cleaning. Screw means extend through it into the upper shell to maintain them and the intermediate plate in sandwiched relationship.

In order to provide suction for conventional or edge cleaning, the rug and floor nozzle includes an integral valve and dial member mounted in the top side of the upper shell section so as to rotate on a vertical axis and provide suction communication between the tubular conduit section of the rug and floor nozzle and the sidewardly and forwardly extending ducts formed between the bottom of the upper shell and top of the intermediate plate.

The rug and floor nozzle is completed by a nonrotatable agitator resiliently mounted therewith and a litter picker also mounted therewith, with both extending through slots in the bottom plate to place them in floor-engaging position during rug and floor nozzle use. A furniture guard is also mounted so as to extend around the rug and floor nozzle proximate the juncture of the top shell and bottom plate to thereby act as a bumper and protect furniture, walls, etc. in the area of cleaning use of the nozzle. It may also be used to effect a seal between top shell and bottom plate.

DESCRIPTION OF THE DRAWINGS

Reference may now be had to the accompanying drawings for a better understanding of the invention, both as to its organization and function, with the illustration being of a preferred embodiment but only as exemplary, and in which.

DETAILED DESCRIPTION OF THE PREFERRED EMBODIMENT

Figure 1:
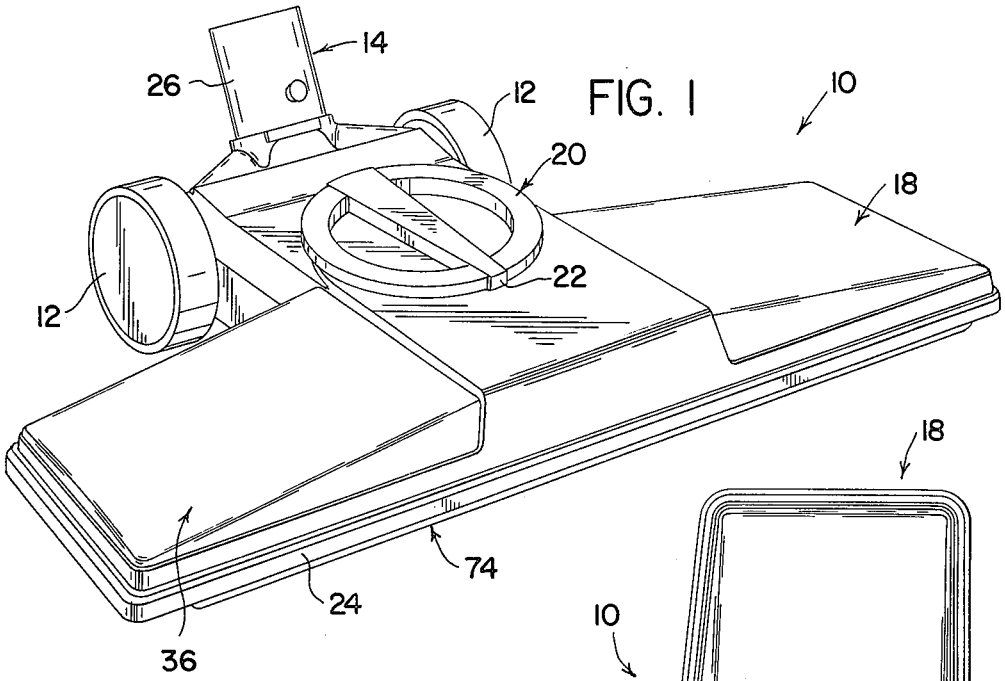
FIG. 1 is a front perspective view of the rug and floor nozzle of the instant invention.
Figure 2:
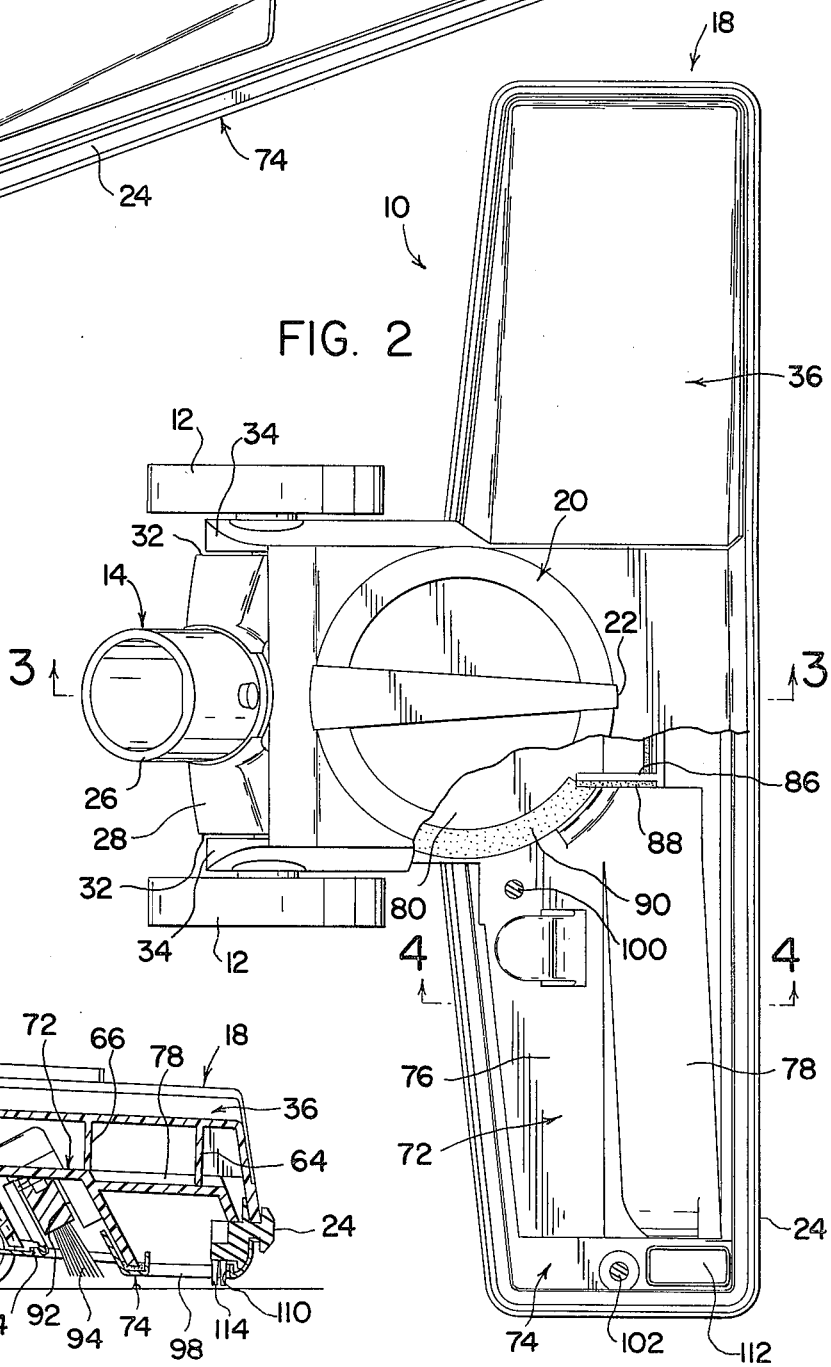
FIG. 2 is a top plan view of the rug and floor nozzle.
Figure 4:
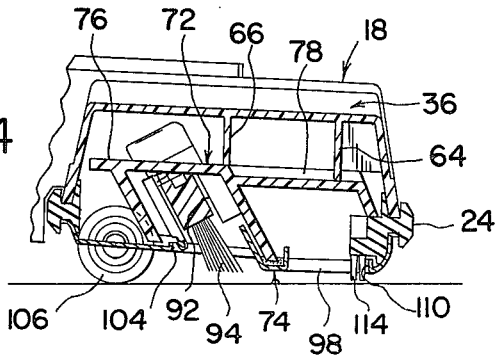
FIG. 4 is a partial cross-sectional elevational view of the nozzle taken on line 4—4 of FIG. 2.
Figure 3:
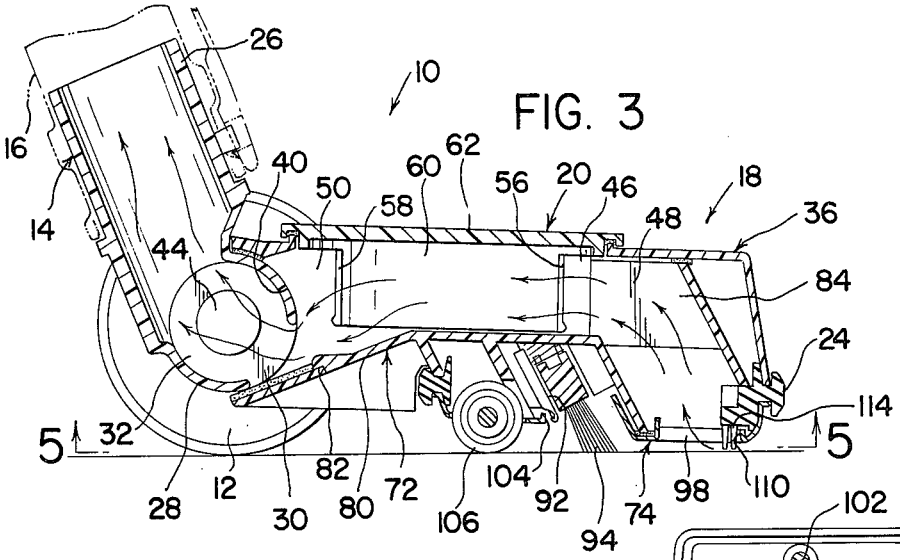
FIG. 3 is a cross-sectional elevational view of the floor nozzle taken on line 3—3 of FIG. 2.
Figure 5:
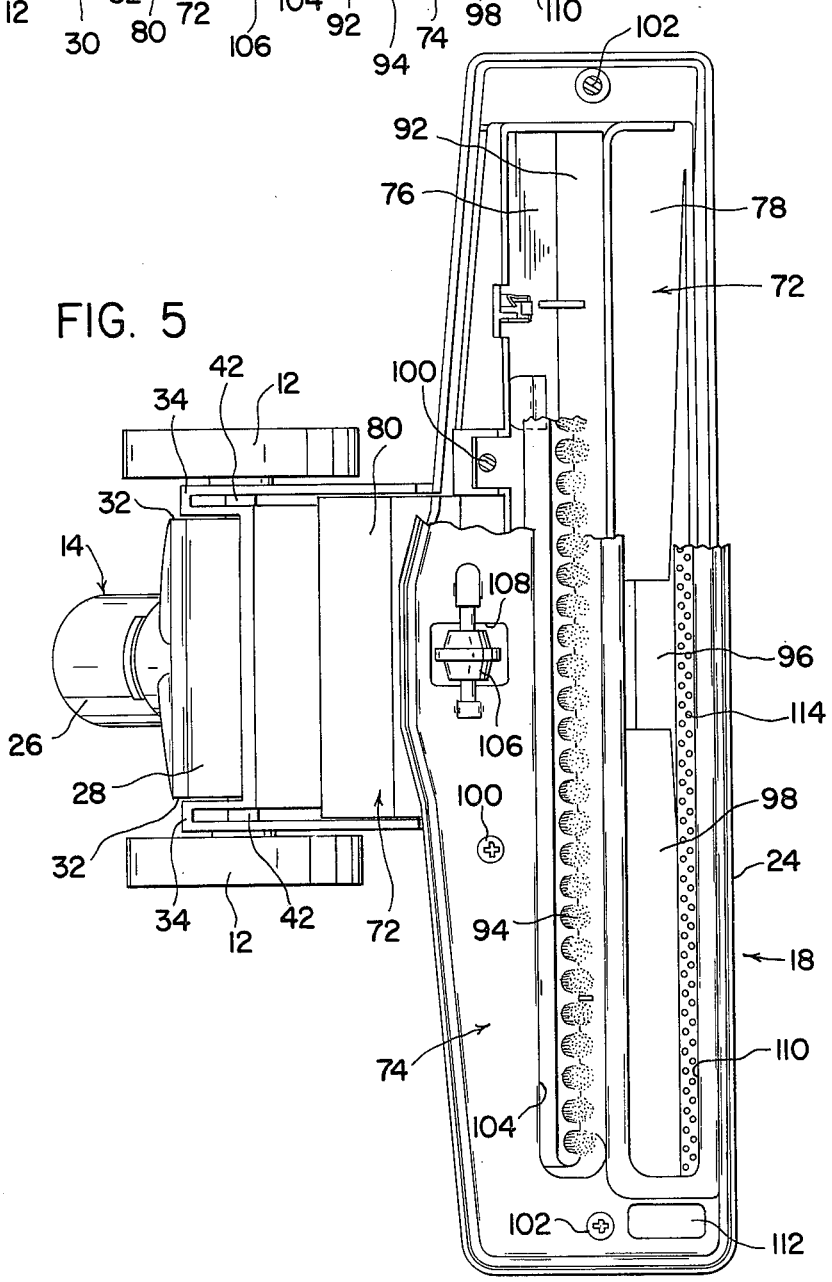
FIG. 5 is a bottom plan view of the rug and floor nozzle, taken on line 5—5 of FIG. 3.

Referring now specifically to FIGS. 1 and 2, it can be seen that a rug and floor nozzle 10 includes a pair of floor-engaging wheels 12, 12, a tubular conduit section 14, for pivotal connection to a cleaner suction hose 16 (FIG. 3), and a floor-engaging nozzle section 18 that is propelled along a floor or rug (not shown) to remove dirt, debris, etc. therefrom and thereby provide for the normal cleaning function of the rug and floor nozzle 10.

Mounted in the top of the nozzle section 18 is a combined dial and valve member 20 which, when properly indexed, as indicated by shaped index means 22, provide for forward or edge cleaning of the rug and floor nozzle 10. Also mounted with the rug and floor nozzle 10 is a furniture guard 24, formed of a resilient material, and stretch-mounted on the floor-engaging nozzle section 18 so as to extend around its major periphery and provide protection for both the rug and floor nozzle 10 and furniture which it might contact or bump during the normal cleaning operation of the rug and floor nozzle 10. The parts just described generally complete the assembled outline or outer periphery of the wheeled rug and floor nozzle 10 which will now be described in somewhat more detail.

Turning now to the remainder of the drawings, it can be seen that the tubular conduit section 14 includes, at its upper end, a hose connecting tube 26 which is integrally connected, at its lower end, to a boss portion 28. Boss portion 28 is, generally, in the form of a hollow tube, as is hose connecting tube 26, but is disposed transverse to the hose connecting tube with the boss portion 28 opening into the hose connecting tube 26 and smoothly merging with it. Boss portion 28 also includes a longitudinally extending open slot 30 at its outer periphery, remote from hose connecting tube 26, so as to provide confluent communication between the suction hose 16 and the floor-engaging nozzle section 18 of wheeled rug and floor nozzle 10. Boss portion 28 also includes capped ends 32, 32 that provide bearing surfaces for swiveling of the tubular conduit section 14 relative to the floor-engaging nozzle section 18.

In order to mount the boss portion 28 for this swiveling action, nozzle section 18 includes a pair of rearwardly disposed leg portions 34, 34, formed integrally with an upper shell 36 of downwardly open configuration of nozzle section 18, and extending parallel to capped ends 32, 32, to bearingly receive the same therebetween. Inwardly extending step portions 38, 38 (only one shown), one being integral with each of the leg portions 34, 34, provide material for the shaping of arcuate depressions 40, 40 (only one shown) for the forward reception of the curvilinear surface afforded by the forward terminations of boss portion 28.

Rotational pivoting of tubular conduit section 14 relative to floor-engaging nozzle section 18 is on an horizontal axis formed by a pair of bolts 42, 42, each mounted so as to extend through one of the leg portions 34 so that a bolt head 44 of each of bolts 42, 42, abuts against the interior face of capped end 32. The outer ends of bolts 42 are attached to wheels 12 inwardly thereof by means of, e.g., C-rings engaging the inner ends of the bolts (not shown) within the wheels 12. This structural arrangement, then, provides for both pivotal mounting of the wheels 12 and also pivotal mounting of the tubular conduit section 14 to the remainder of the rug and floor nozzle 10.

Figure 6:
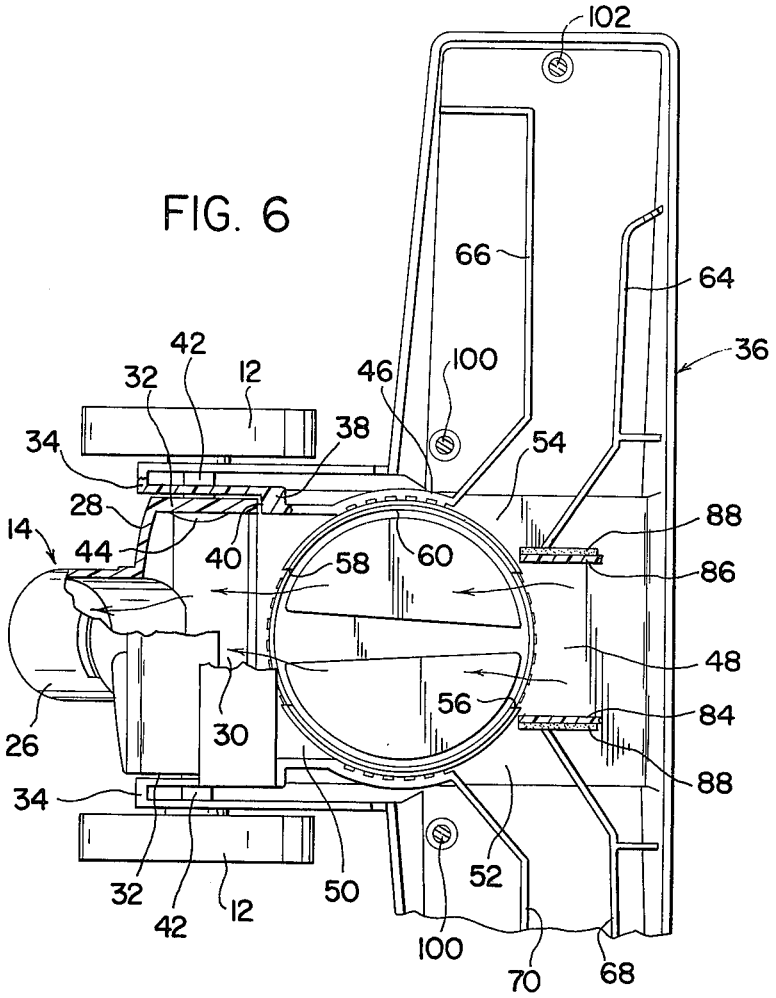
FIG. 6 is a bottom plan view of the rug and floor nozzle showing generally the underside of the top shell with the nozzle conditioned for normal cleaning.
Figure 7:
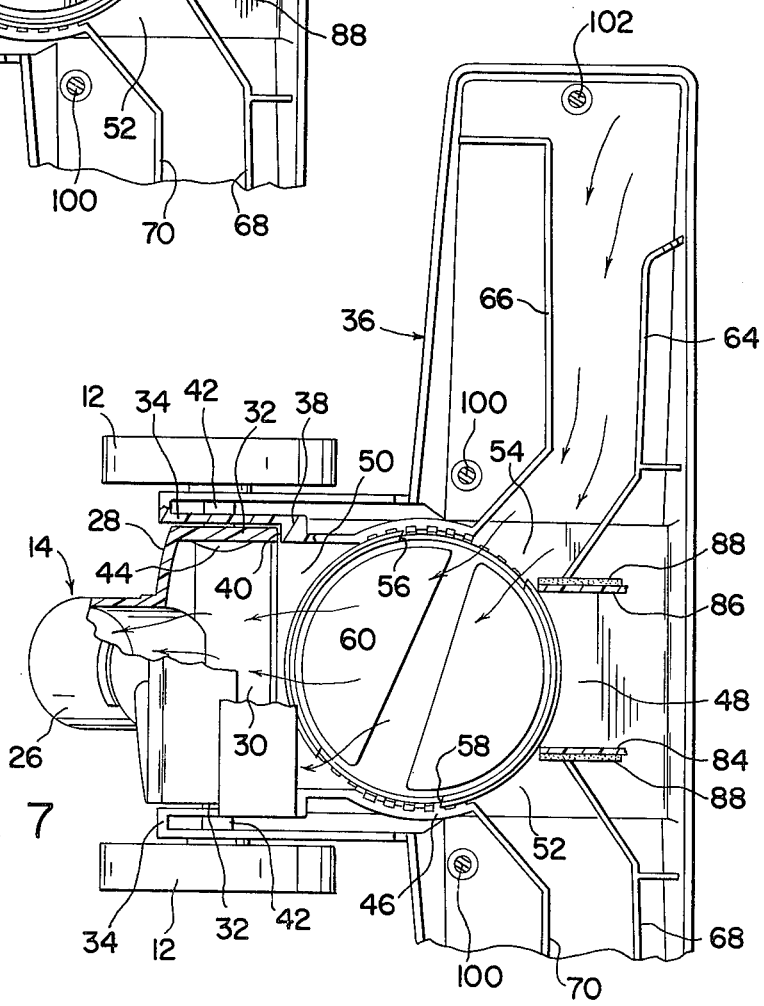
FIG. 7 is a partial bottom plan view similar to FIG. 6 but showing the nozzle conditioned for edge cleaning.

Upper shell 36 of floor-engaging nozzle section 18 includes a circular cross-sectional, vertically extending well or journalizing portion 46 (FIGS. 6 and 7) which has front and rear openings 48, 50 and side openings 52, 54, disposed one on each side of front openings 48, to serve as a suction air communicating path between the tubular conduit section 14 and more forward portions of floor-engaging nozzle section 18 during the cleaning function. Suction air communication is then selectively had between the rear opening 50 and the forward or side openings 48, 52 and 54 through movement of dial and valve member 20.

This is accomplished in the following manner. Dial and valve member 20 includes a pair of forward and rearward slots 56, 58 respectively (FIG. 3) disposed in a vertically extending circular wall 60 thereof situated in depending and integral relationship with a top face 62 of dial and valve member 20. Thus, movement of dial and valve member 20 in a pivotal manner around its vertical axis provides selective communication between the rear opening 50 in round wall 46 with one of the front or side openings 48, 52, 54 of this wall so that suction cleaning air may be confluently communicated from the hose 16 to more forward portions of the nozzle section 18.

Also situated within upper shell 36 of floor-engaging nozzle section 18 is a pair of leftwardly extending wall portions 64, 66 and a pair of rightwardly extending wall portions 68, 70 that form sections of the passageways or conduits that provide for the edge cleaning function of the rug and floor nozzle 10. More specifically, the wall portions 64, 68 are the forwardmost wall portions, while the wall portions 66, 70 are the rearwardmost wall portions. Each forward wall portion, in conjunction with its complementary rearward wall portion and the bottom face of upper shell 36 disposed therebetween, form three of the sides of the aforesaid passageway or conduit. The fourth bottom side of the two sidewardly extending passageways are, of course, formed by sections of an intermediate plate or member 72 that has a generally large side to side and front to back plate-like extent and that is receivingly maintained in sandwiched relationship between upper shell 36 and a bottom plate 74.

Each end of intermediate plate 72 includes a relatively flat face 76, located relatively rearwardly, and a tapering face 78, located relatively forwardly and forming the aforesaid fourth side of the conduit or passageway. Tapering face 78 tapers downwardly relative to upper shell 18 so as to form an expanding volume for the conduit or passageway and with two of these faces again being disposed one on each side of the dial and valve member 20, to provide edge cleaning for both edges of rug and floor nozzles.

Intermediate plate 72 also includes a rearwardly extending medial portion 80 that terminates in a lip 82 that engages above the bottom face of boss portion 28 so as to complete the closing 17 of the center fed air channel extending to dial and valve member 20 from suction hose 16. Intermediate plate 72 also includes a pair of upwardly extending wall portions 84, 86, disposed forwardly of dial and valve member 20, which furnishes that portion of the normal, forward cleaning flow passageway immediately downstream of the dial and valve member 20 and proximate slot 56 in dial and valve member 20. Flocking material or felt 88 may be utilized in this area on the outer side of the wall portions 84, 86 to make a more airtight connection between them and the inner abutting ends of forward wall portions 64, 68. Flocking or felt 90 may also be utilized as a sealing and seating means for dial and valve member 20.

The intermediate plate 72 has its structure generally completed by a downwardly opening wall 92, utilized for mounting an agitator brush 94 and a central opening 96 communicating with a tunnel 98, extending longitudinally relative to the general outline of the major portion of rug and floor nozzle 10. Central opening 96 communicates with the channel between wall portions 84, 86 and provides for forward cleaning, through tunnel 98, over nearly the entire width of rug and floor nozzle 10.

The assemblage of the rug and floor nozzle 10 is completed by the aforementioned bottom plate 74, this member, ideally, being a metal stamping while the upper shell and intermediate plate conveniently take the form of molded plastic member. The bottom plate member is generally flat and mounted beneath the intermediate plate 72 and upper shell 36 and is maintained in this position by screws 100, 100 extending into the intermediate plate 72 and screws 102, 102 extending into the upper shell 36. Thus, the intermediate plate 72 is sandwiched between the bottom plate 74 and upper shell 36 so that the passageways or channeling (of somewhat intricate requisite shape) may be formed by the combined inter-engagement of the upper shell 36 and intermediate plate 27 so that these pieces may be easily molded. At the same time, the bottom plate may be conveniently stamped from thin sheet metal because of its fairly simple configuration. It thereby provides a durable wear surface where actually required.

Bottom plate 74 includes an elongated, longitudinally extending aperture 104 so as to permit brush 94 to project downwardly and outwardly of the rug and floor nozzle 10 to be properly positioned for floor engagement. A roller 106 is also mounted in the bottom plate 74 by offsetting to extend outwardly of an aperture 108 so as to also be in floor-engaging position and provide support for the rug and floor nozzle 10 on all but very plush carpets.

Apertures are also provided in bottom plate 74 for edge and front cleaning. More specifically, an elongated aperture 110 extending substantially from side to side is located in the forward portions of bottom plate 74 that opens inwardly to the tunnel 98 to provide the standard floor cleaning function for the rug and floor nozzle 10. Edge cleaning is occasioned through sidewardly disposed apertures 112, 112 (only one shown) with these apertures communicating with the channels formed between the depending walls 64, 68 and 70 that extend generally to the apertures 112, 112 situated between the outward termination of intermediate plate 72 and the outward termination of upper shell 36. A litter picker 114 may also be included in rug and floor nozzle 10 to complete its configuration It should now be obvious that all the desired advantages set out in the beginning portion of the specification have been satisfied by the described structure. It should be further apparent that many modifications could be made to the described mechanism which would still fall within the spirit and purview of the description offered.

What is claimed is:

1. A nozzle having an edge cleaning function including;

a. an upper shell member forming at least partially a housing for said nozzle, b. an intermediate member disposed against said upper shell member, c. conduit means formed between said upper shell member and said intermediate member for providing for a suction air flow for said edge cleaning function, d. a bottom plate wear member attached to said upper shell member and sandwiching said intermediate member therebetween, e. said nozzle also including a conduit means for providing for a suction air flow for a normal forward cleaning function, f. a rotary valve means providing selective communication with a suction source and one of said conduit means for providing a suction flow of air for selective edge and forward cleaning for said nozzle, g. said rotary valve means including a rotary valve member that rotates on a generally vertical axis, h. said rotary valve member being movingly disposed in a means for journalling the same formed by at least partially circular vertically extending walls, i. terminations of said vertical extending walls providing openings for the passage of a suction flow of air within said nozzle, j. said rotary valve member including a vertically extending slotted rim, having at least a pair of vertically aligned slots for the passage of a suction flow of air, k. said openings including at least a pair of front and rear openings formed by terminations of said vertical walls, said front and rear openings also being vertically aligned, and l. said front opening of said openings formed by terminations of said vertical walls communicating with said conduit means for forward and edge cleaning.

2. The nozzle of claim 1 wherein;

a. at least one of said upper shell member and said intermediate member include said vertically extending walls abutting against the other of said upper shell and intermediate member, b. said vertically extending walls providing, along with a portion of said upper shell member and said intermediate member, said conduit means for edge cleaning comprising laterally extending passage means for the passage of a suction flow of air and said conduit for forward cleaning comprising forwardly extending passage means for the passage of a suction flow of air.

3. A nozzle having forward and edge cleaning functions including;

a. an upper shell member having a downwardly opening configuration and forming at least partially a housing for said nozzle, b. an intermediate member disposed below and nested within and against said upper shell member, and providing, generally, a plate-like extent within said open configuration, c. conduit means for the passage of a suction air flow formed wholly by said upper shell member and said intermediate member including forwardly extending conduit means for forward cleaning and sidewardly extending conduit means for edge cleaning, d. a generally flat, elongated bottom plate stamping removably attached to said upper shell and closing said downwardly opening configuration and abuttingly holding and sandwiching said intermediate member between it and said upper shell, e. said bottom plate including (1) an elongated aperture for the passage of a suction air flow for forward cleaning extending substantially from side to side in said bottom plate and (2) at least one aperture disposed in said bottom plate outwardly thereof for the passage of a suction air flow for edge cleaning, and f. said forwardly extending conduit means communicating with said elongated aperture and said sidewardly extending conduit means communicating with said one aperture.

4. A nozzle utilized for edge and forward cleaning including;

a. a shell member, b. an intermediate member, c. a rotary valve member rotatably mounted through the top surface of said shell member and having a vertically extending slotted wall, d. air flow passageways formed in said nozzle between said shell member and said intermediate member, e. a bottom plate attached to said shell member and maintaining said intermediate member therebetween, f. one of said shell member and intermediate member including vertical walls for forming at least a portion of said air flow passageways, g. said vertical walls terminating adjacent said rotary valve for providing vertically extending apertures, h. said slots in said wall of said rotary valve member being confrontable with said vertically extending apertures formed by said wall terminations upon rotary manipulation of said valve member, and i. said rotary valve member extending vertically outwardly above the top surface of said shell member to form a combined dial and valve member for easy top access for said rotary manipulation.

* * * * *